US008360550B2

(12) United States Patent
Miyazawa et al.

(10) Patent No.: US 8,360,550 B2
(45) Date of Patent: Jan. 29, 2013

(54) FLUID EJECTING APPARATUS AND MAINTENANCE METHOD

(75) Inventors: Hisashi Miyazawa, Okaya (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 135 days.

(21) Appl. No.: 12/914,180

(22) Filed: Oct. 28, 2010

(65) Prior Publication Data

US 2011/0102498 A1 May 5, 2011

(30) Foreign Application Priority Data

Oct. 29, 2009 (JP) ..... 2009-248932

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS

2005/0078145 A1* 4/2005 Inoue ..... 347/31
2006/0214984 A1* 9/2006 Hirakawa ..... 347/31
2010/0118084 A1 5/2010 Seshimo

FOREIGN PATENT DOCUMENTS

JP 2008-238561 9/2008
JP 2008-238562 10/2008

* cited by examiner

*Primary Examiner* — Matthew Luu
*Assistant Examiner* — Alejandro Valencia
(74) *Attorney, Agent, or Firm* — Workman Nydegger

(57) ABSTRACT

A fluid ejecting apparatus including: a fluid ejection head configured to eject fluid from a plurality of nozzles; a medium supporting member configured to support a medium at a position opposing the fluid ejection head, a thread-type fluid absorbing member configured to absorb the fluid ejected from the nozzles; and a moving mechanism configured to cause the fluid absorbing member to move between a first position opposing the nozzles between the fluid ejection head and the medium supporting member and a second position farther from a nozzle surface of the fluid ejection head than a transporting area of the medium, wherein the fluid is ejected from the nozzles to the fluid absorbing member at the first position.

9 Claims, 10 Drawing Sheets

FLUID EJECTING APPARATUS AND MAINTENANCE METHOD

BACKGROUND

1. Technical Fields

The present invention relates to a fluid ejecting apparatus and a maintenance method therefore.

2. Related Art

In the related art, as a fluid ejecting apparatus configured to eject ink (fluid) to a printing paper (medium), an ink jet printer (hereinafter, referred to as a printer) is widely known. In the printer as described above, there is a problem of nozzle clogging due to increased viscosity or solidification of ink caused by evaporation of ink from nozzles of a printhead, adhesion of dust thereto, or entry of air bubbles, which results in defect printing. Therefore, normally, the printer is configured to perform a flashing operation which forcedly discharges ink in the nozzles in addition to ejection to the printing paper.

For example, JP-A-2008-238561 and JP-A-2008-238562 disclose a configuration including a capping device which moves upward and downward in association with the movement of a carriage to bring a cap-shaped ink receiving member into contact with the printhead to achieve a capped state when maintenance is performed.

On the other hand, when the flashing operation is performed between a printing paper and another printing paper (between papers) during the printing operation, the printhead cannot be moved. Therefore, for example, there is a known method of discharging ink toward the cap-shaped ink receiving member provided downward of the printhead during the flashing operation. However, since the ink receiving member is located at a position lower than a sealing surface with respect to the printhead except for a period when maintenance is performed, if an attempt is made to cause the flashing process to be performed between the printing papers being transported during printing, as the distance between the printhead and the ink receiving member is larger than the distance between the printhead and the printing paper, there arises a problem such that ink droplets ejected from the printhead is liable to be transformed into mist.

In order to solve this problem, placing the ink receiving member at a position closer to the printhead is conceivable. Since the flashing process is performed during the printing, the ink receiving member needs to be moved upward and downward at a high speed with respect to the printhead. However, the ink receiving member which assumes a cap shape has a large mass, and hence is not suitable for being moved upward and downward at a high speed because an increased load is resulted.

In this manner, it is difficult to bring the ink receiving member arranged downward of a printing paper transporting plane closer to the printhead between the printing papers being printed continuously. In particular, in a printer having a high-speed printing performance such as a line head printer, the printing performance might be lowered due to the flashing operation.

Since the ink receiving member comes into abutment with the nozzle surface of the printhead, there is a probability that the ink receiving member may come into abutment with the nozzles and thus break meniscuses.

SUMMARY

An advantage of some aspects of the invention is to provide a fluid ejecting apparatus which is capable of suppressing transformation of fluid into mist during a flashing operation and improving a printing capability, and a maintenance method therefore.

A fluid ejecting apparatus according to an aspect of the invention includes: a fluid ejection head configured to eject fluid from a plurality of nozzles; a medium supporting member configured to support a medium at a position opposing the fluid ejection head, a thread-type fluid absorbing member configured to absorb the fluid ejected from the nozzles; and a moving mechanism configured to cause the fluid absorbing member to move between a first position opposing the nozzles between the fluid ejection head and the medium supporting member and a second position farther from a nozzle surface of the fluid ejection head than a transporting area of the medium, wherein the fluid is ejected from the nozzles to the fluid absorbing member at the first position.

In this configuration, the fluid is ejected from the nozzles to the thread-type fluid absorbing member at the first position at which the fluid absorbing member opposes the nozzles between the fluid ejection head and the medium supporting member. Since the fluid absorbing member absorbs the fluid at a position closer to the fluid ejection head than the medium or at the equivalent position, the fluid can be absorbed without being transformed into mist. Since there is provided the moving mechanism configured to move the fluid absorbing member between the first position and the second position farther from the nozzle surface of the fluid ejection head than the transporting area of the medium, the fluid absorbing member in question can be prevented from coming into contact with the medium transported on the transporting area at the second position. In addition, since the fluid absorbing member is easy to move because it is of the thread type and hence is small in mass. In addition, since the fluid absorbing member can be moved to the second position by a small distance of movement, the flashing operation can be terminated in a short time.

Preferably, the second position is a state in which the fluid absorbing member is accommodated in a depression provided on the medium supporting member.

In this configuration, since the second position corresponds the state in which the fluid absorbing member is accommodated in the depression provided on the medium supporting member, the contact with the medium transported in the transporting area is reliably prevented, and the retracted position for the fluid absorbing member can be secured easily. Since the fluid absorbing member is of the thread type, the size of the depression may be small.

Preferably, an absorbing member configured to absorb the fluid is provided in the depression.

In this configuration, the fluid in the fluid absorbing member is absorbed (collected) in the absorbing member, so that the fluid absorbing performance of the fluid absorbing member is restored.

Preferably, a sucking mechanism configured to suck the fluid in the depression is provided.

In this configuration, since the sucking mechanism configured to suck the fluid in the depression is provided, the fluid is prevented from becoming deposited and solidifying in the depression. Accordingly, the fluid absorbing ability of the fluid absorbing member can be restored quickly, and stable flashing operation is enabled.

Preferably, the moving mechanism has a function to move the fluid absorbing member in the direction parallel to the nozzle surface of the fluid ejection head.

In this configuration, since the moving mechanism has a function to move the fluid absorbing member in the direction parallel to the nozzle surface of the fluid ejection head, the fluid supporting member can be opposed to a predetermined nozzle (object of the flashing process) of the fluid ejection head, so that the satisfactory flashing process is achieved.

Preferably, the fluid ejection head includes a plurality of nozzle rows, and the moving mechanism has a function to move the fluid absorbing member in the direction of arrangement of the nozzle rows.

In this configuration, the plurality of nozzle rows are provided on the fluid ejection head, and the moving mechanism has a function to move the fluid absorbing member in the direction of arrangement of the nozzle rows.

In this configuration, the fluid absorbing member can be opposed to the plurality of nozzle rows of the fluid ejection head in sequence, and the flashing operation can be performed for all the nozzle rows.

Preferably, the medium supporting member includes a moving panel member configured to be movable in the direction parallel to the nozzle surface of the fluid ejection head, and the moving panel member is formed with the depression.

In this configuration, since the medium supporting member includes the moving panel member configured to be movable in the direction parallel to the nozzle surface of the fluid ejection head, and the moving panel member is formed with the depression, the case where the fluid absorbing member is moved in the direction of transport of the medium is also supported.

Preferably, a plurality of the depressions are provided and the plurality of depressions oppose the nozzle rows arranged on the fluid ejection head in the direction of transport of the medium, respectively.

In this configuration, since the plurality of depressions oppose the nozzles arranged on the fluid ejection head in the direction of transport of the medium, the medium supporting member (a plurality of depressions) can be fixed to the predetermined positions in advance. Accordingly, the complex positional control between the fluid absorbing member and the depression is no longer necessary.

Preferably, a moving mechanism having a function to adjust a tension to be applied to the fluid absorbing member is provided, and the first position is a state in which the tension is applied to the fluid absorbing member by the moving mechanism and the second position is a state in which the tension is not applied to the fluid absorbing member by the moving mechanism.

In this configuration, the tension of the fluid absorbing member is adjusted by the moving mechanism having the function to adjust the tension of the fluid absorbing member. At the first position, by applying the tension to the fluid absorbing member, the fluid absorbing member can be arranged at the position opposing the nozzle rows without being sagged, so that the fluid ejected from the nozzles can be absorbed. In addition, the fluid absorbing member can be moved to the second position which is farther from the nozzle surface than the transporting area of the medium easily by allowing the fluid absorbing member to sag by not applying the tension.

A maintenance method according to an aspect of the invention includes: performing a flashing operation for causing fluid to be ejected from a plurality of nozzles of a fluid ejection head to a thread-type fluid absorbing member by moving the fluid absorbing member to a first position opposing the nozzles of the fluid ejection head, and then moving the fluid absorbing member having absorbed the fluid discharged from the nozzles to a second position which is farther from the nozzle surface of the fluid ejection head than a transporting area of the medium.

In this configuration, the flashing operation is performed by moving the fluid absorbing member to the first position opposing the nozzles of the fluid ejection head, and then the fluid absorbing member having absorbed the fluid discharged from the nozzles is moved to the second position which is farther from the nozzle surface of the fluid ejection head than a transporting area of the medium. Accordingly, the fluid discharged from the nozzles can be absorbed at the first position opposing the nozzle before being transformed into mist, and the contact between the fluid absorbing member and the medium being transported in the transporting area can be avoided at the second position. Since the fluid absorbing member is a thread-type member, the fluid absorbing member can be moved between the first position and the second position by a small distance of movement. Therefore, the flashing operation can be terminated in a short time.

Preferably, when moving the fluid absorbing member to the second position, the depression provided on the medium supporting member configured to support the medium at the position opposing the fluid ejection head is present at the position opposing the fluid absorbing member, and the fluid absorbing member is arranged in the depression.

In this configuration, the fluid absorbing member can be accommodated in the depression only by moving the same in the direction away from the nozzles, that is, downward in the vertical direction. Accordingly, the distance of travel of the fluid absorbing member is minimized, and the time required for traveling the fluid absorbing member can be shortened.

Preferably, in order to vary the distance between the fluid ejection head and the medium supporting member configured to support the medium according to the type of the medium, the fluid ejection head is configured to be capable of advancing and retracting with respect to the medium supporting member, and whether the fluid absorbing member is to be moved to the first position or not is selected according to the type of the medium at the time of the flashing operation.

In this configuration, arrangement of the fluid absorbing member to the first position or the second position according to the type of the medium makes driving easy and achieves power saving. Also, since the flashing operation is achieved without moving the fluid absorbing member to the first position, shortening of the processing time is achieved, and the printing speed is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
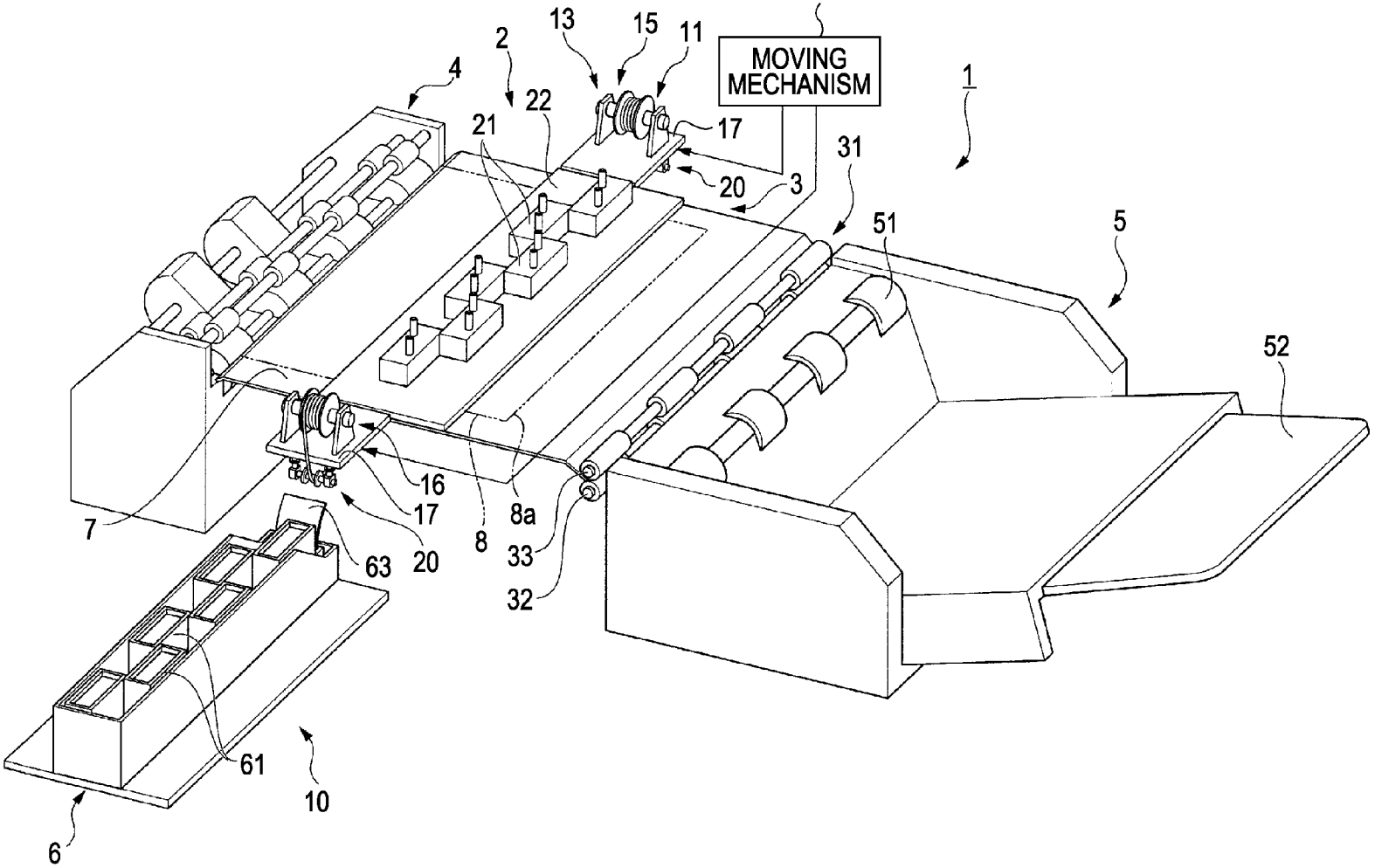
FIG. 1 is a perspective view showing a schematic configuration of a printer in a first embodiment.

Referring now to the drawings, embodiments of the invention will be described. In the respective drawings used in the description below, scaling of the respective members is changed as needed in order to make the respective members visibly recognizable.

In the description given below, an ink jet printer (hereinafter, referred to simply as a printer) as an example of a liquid ejecting apparatus in the invention will be described.

First Embodiment

FIG. 1 is a perspective view showing a schematic configuration of a printer in a first embodiment of a fluid ejecting apparatus in the invention.

As shown in FIG. 1, a printer (fluid ejecting apparatus) 1 in the first embodiment includes a head unit 2, a transporting device 3 configured to transport a printing paper (medium) 8, a feed unit 4 configured to supply the printing paper 8, a paper output unit 5 configured to receive an output of the printing paper printed by the head unit 2, and a maintenance device 10 configured to perform a maintenance process for the head unit 2.

The transporting device 3 includes a platen (medium supporting member) 7 configured to support the printing paper 8 from the side of the lower surface thereof and a transporting roller 31 configured to transport the printing paper 8 on the platen 7 to the paper output unit 5.

The platen 7 is a member for supporting the transported printing paper 8 and defines a predetermined distance (hereinafter, referred to as "platen gap") to nozzle surfaces 23 (see FIG. 2) of a plurality of printheads (fluid ejection heads) 21 which constitute the head unit 2, and is arranged at a position opposing the head unit 2.

The transporting roller 31 is a nip roller provided with a driving roller 32 and a driven roller 33 opposing thereto. The driving roller 32 is connected to a drive motor, not shown, and is configured to be rotated by the drive motor.

The paper output unit 5 includes a discharging roller 51 and a paper discharge tray 52 configured to hold the printing paper 8 after the printing process, which is transported by the discharging roller 51.

The head unit 2 includes the plurality of printheads 21 (fluid ejection heads) and a mounting plate 22 configured to support the plurality of printheads 21.

The plurality of printheads 21 are arranged over an effective printing width of the head unit 2 and arranged in a zigzag pattern as a whole instead of being linearly arranged. In other words, the adjacent printheads 21 are shifted from each other in the direction intersecting the direction of transport of the printing paper 8 by a predetermined pitch. In this embodiment, adjacent two head groups M and N (FIG. 2) in the direction of transport of the printing paper 8 each include three printheads 21. However, the number of the printheads 21 is not limited thereto.

The maintenance device 10 includes a cap unit 6 configured to perform a sucking process for the head unit 2 and a flashing unit 11 configured to perform the flashing operation.

The cap unit 6 is a member configured to perform the maintenance process such as capping or the sucking operation for the head unit 2, and includes four cap members 61 corresponding to the four printheads 21. The cap unit 6 is arranged at a position away from a printing area of the head unit 2.

The cap members 61 are configured to be capable of coming into abutment with the nozzle surfaces 23 (FIG. 2) of the printheads 21. Satisfactory capping is achieved by the cap members 61 which comes into tight contact respectively with the nozzle surfaces 23 of the printheads 21, and the sucking operation for causing ink to be discharged from the nozzle surfaces 23 is achieved satisfactorily.

The cap unit 6 includes a wiping member 63 used for a wiping process for wiping the nozzle surfaces 23 of the printheads 21.

The head unit 2 in this embodiment is movable between a printing position and a maintenance position by a carriage, not shown. Here, the printing position is a portion opposing the transporting device 3 for performing the printing operation with respect to the printing paper. In contrast, the maintenance position is a position retracted from the position on the transporting device 3, and is a position opposing the cap unit 6 of the maintenance device 10. In this maintenance position, the maintenance process of the head unit 2 (sucking process and wiping process) is performed.

The head unit 2 is arranged at the printing position in such a manner that respective nozzle rows L (FIG. 2) of the respective printheads 21 extend in parallel to an upstream end 8*a* in the direction of transport of the printing paper 8 transported by the transporting device 3.

Figure 2:
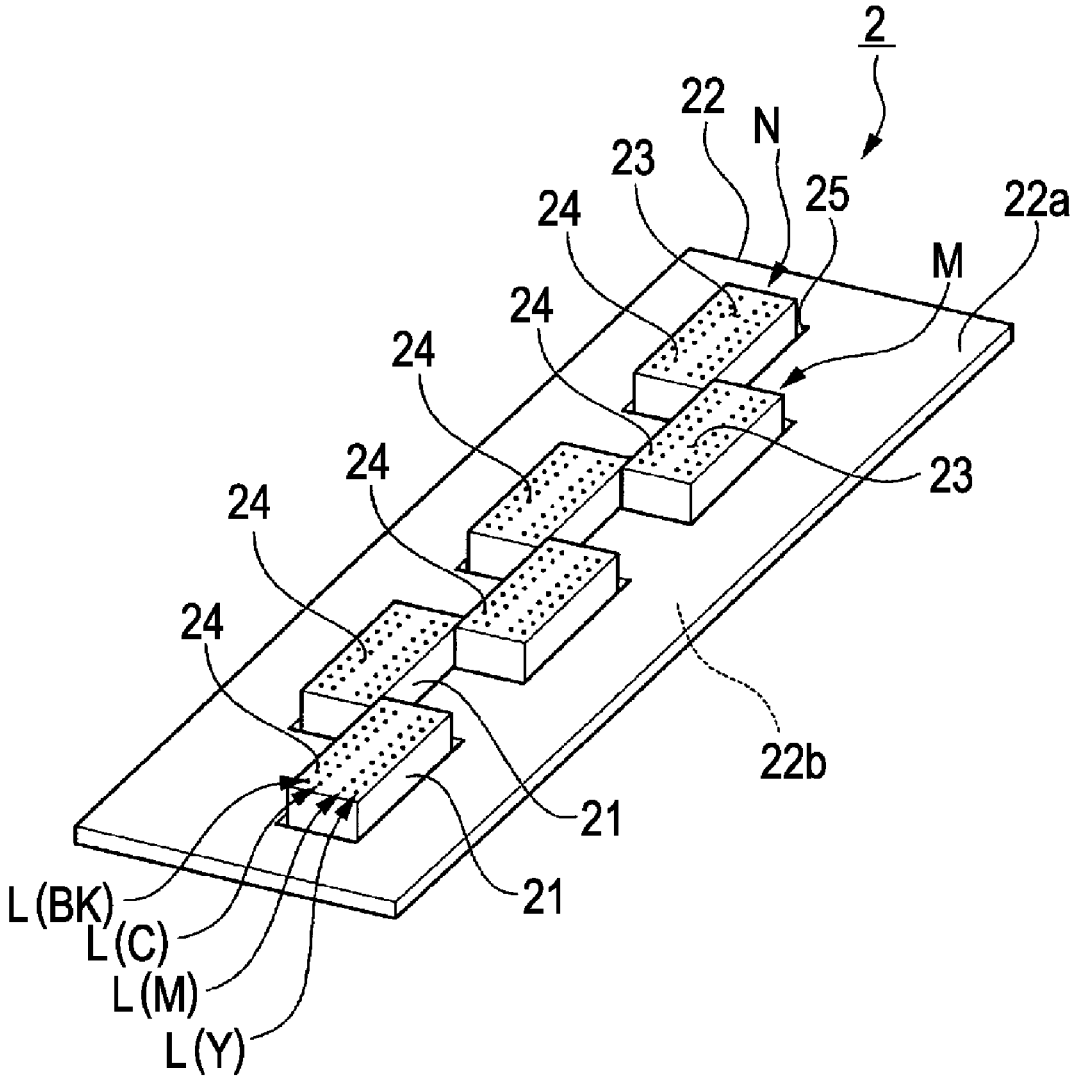
FIG. 2 is a perspective view showing a lower side of a printhead provided in the printer in the first embodiment.

FIG. 2 is a perspective view showing an underside of the head unit 2. As shown in this drawing, the each printhead 21 includes a plurality of nozzles 24 configured to discharge eject ink for each color. Here, the plurality of nozzles 24 which discharges ink of the same type (for example, Black Bk, magenta M, yellow Y, and cyan C) are arranged and constitute one nozzle row L.

More specifically, the printheads 21 include four rows of nozzles (L (Y), L (M), L (C), and L (Bk)) corresponding to the four colors (yellow (Y), magenta (M), cyan (C), and black (Bk)). The plurality of nozzles 24 which constitute the each nozzle row (L (Y), L (M), L (C), and L (Bk)) are arranged in the direction intersecting the direction of transport of the printing paper 8. More preferably, they are arranged in the horizontal direction orthogonal to the direction of transport of the printing paper 8.

The printheads 21 are arranged in respective openings 25 formed in the mounting plate 22. Specifically, the respective printheads 21 are secured to a back surface 22*b* of the mounting plate 22, for example, with screws, so that the nozzle surfaces 23 project from the surface 22*a* of the mounting plate 22 via the openings 25.

Figure 3:
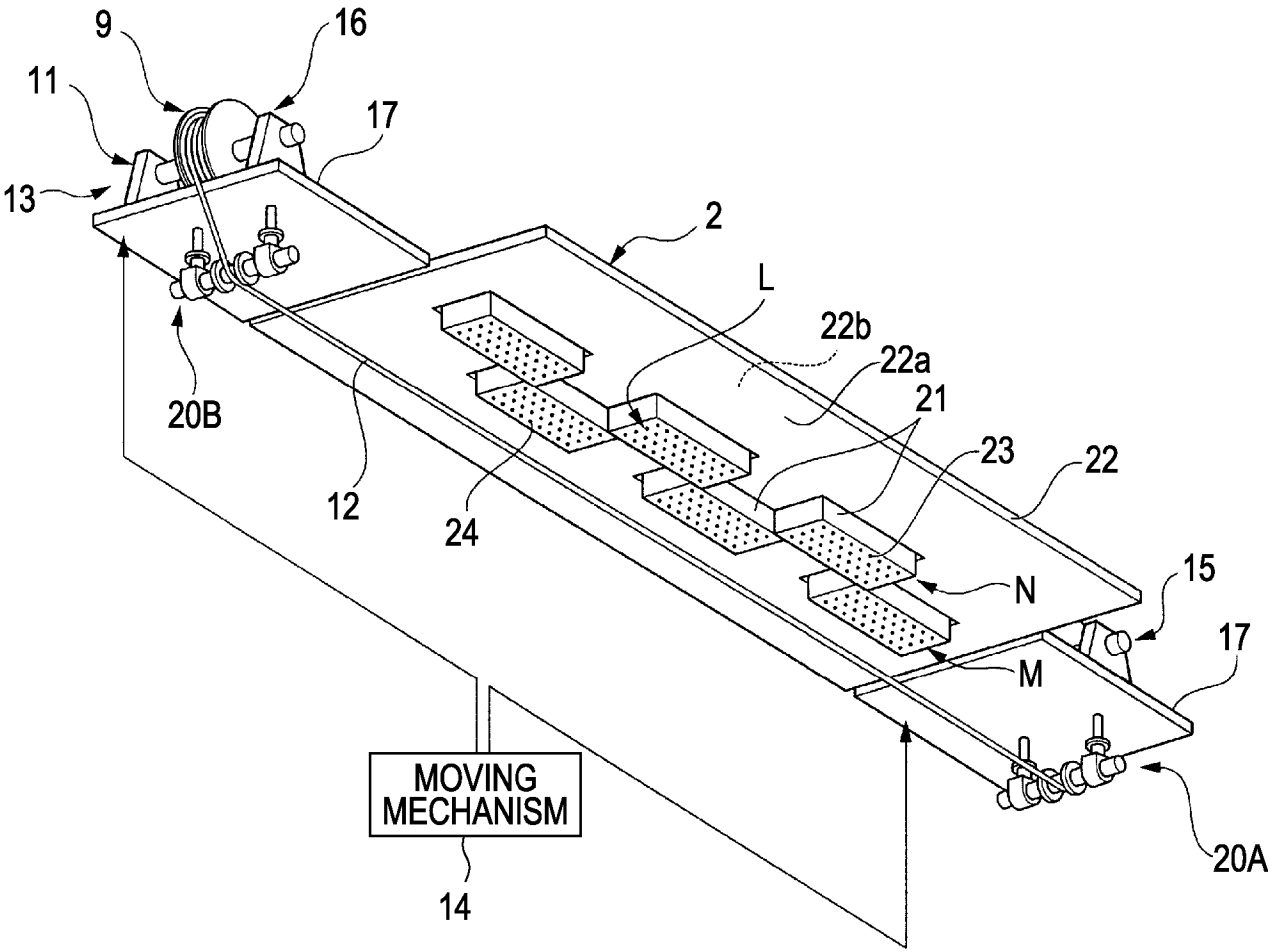
FIG. 3 is a perspective view of a head unit and a flashing unit provided in the printer in the first embodiment viewed upward from below.
Figure 4:
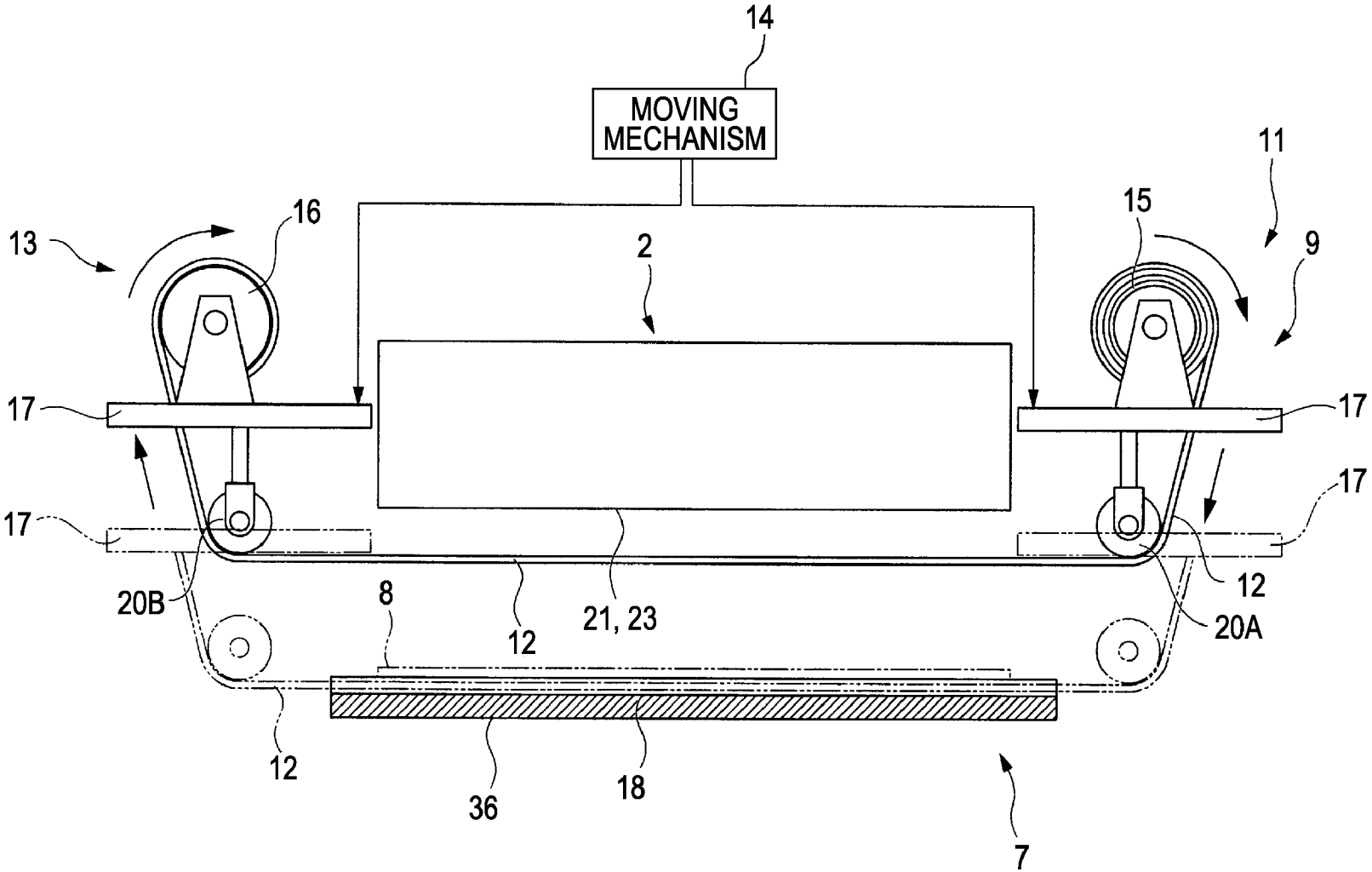
FIG. 4 is a diagrammatic view of the head unit and the flashing unit viewed from the direction of transport of a printing paper.

FIG. 3 is a perspective view of the head unit 2 and the flashing unit 11 viewed upward from below. FIG. 4 is a schematic view of the head unit 2 and the flashing unit 11 viewed from the direction of transport of the printing paper.

The flashing unit 11 includes a thread-type fluid absorbing member 12 configured to absorb ink discharged at the time of flashing operation and a supporting mechanism 9 configured to support the fluid absorbing member 12 as shown in FIG. 3 and FIG. 4.

The fluid absorbing member 12 is a thread-type absorbing member configured to absorb ink discharged from the respective nozzles 24, which extends over the effective printing width of the head unit 2, and is provided so as to extend along the nozzle rows L of the plurality of printheads 21 arranged in the direction intersecting the direction of transport of the printing paper 8. The fluid absorbing member 12 is positioned between the nozzle surfaces 23 of the printheads 21 and a transporting area for the printing paper 8 on the platen 7.

As the fluid absorbing member 12, fibers such as silk, cotton, or polyester, or compound fiber of these materials may be used. The fluid absorbing member 12 preferably has an enough thickness to ensure sufficient absorbency to retain ink discharged from the nozzles though the flashing operation. Specifically, the fluid absorbing member 12 is set to be a thread having a diameter of, for example, about 0.1 to 1.0 mm, more preferably, having a diameter on the order of 0.5 mm. However, the thickness of the fluid absorbing member 12 is set to be such that the maximum cross-sectional dimension does not exceed a dimension obtained by subtracting the amount of displacement caused by sagging of the fluid absorbing member 12 from the distance from the printheads 21 to the transporting area for the printing paper 8 in order to prevent the contact to the printheads 21 and the printing paper 8.

The fluid absorbing member 12 has a width on the order of 5 to 50 times the nozzle diameter. In this embodiment, a gap between the nozzle surfaces 23 of the printheads 21 and the platen 7 is on the order of 2 mm, and the nozzle diameter is about 0.02 mm. Therefore, if the diameter of the fluid absorbing member 12 is 1 mm or smaller, the fluid absorbing member 12 can be placed between the respective nozzle surfaces 23 and the platen 7 and, even when considering components having dimensional errors, discharged ink can be caught by the absorbing member.

The length of the fluid absorbing member 12 is preferably a sufficient length with respect to the effective printing width of the head unit 2. Although it will be described later in detail, the fluid absorbing member 12 is configured in such a manner that a used area of the fluid absorbing member 12 (in which ink is already absorbed) is wound up in sequence and, if the entire area of the fluid absorbing member 12 has absorbed the ink, the fluid absorbing member 12 by itself is replaced. Therefore, in order to set the interval of replacement of the fluid absorbing member 12 to a practical period, the length of the fluid absorbing member 12 is preferably set to a length on the order of several hundred times the effective printing width of the head unit 2. The fluid absorbing member 12 is supported so as to extend in the direction intersecting the direction of transport of the printing paper 8 by the supporting mechanism 9.

The supporting mechanism 9 includes a moving mechanism 13 and a moving mechanism 14.

The moving mechanism 13 includes rotating units 15 and 16 provided at both ends of the head unit 2 in the direction intersecting the direction of transport and having axes of rotation extending parallel to the direction of transport of the printing paper 8, respectively, on the back surface 22*b* of the mounting plate 22 (a surface opposite from the nozzle surfaces 23 of the respective printheads 21).

The rotating units 15 and 16 each are a winding mechanism which assumes a bobbin shape including a pair of partitioning panels disposed at a predetermined interval and allows the fluid absorbing member 12 to be wound between the partitioning panels. The rotating units 15 and 16 are driven by a drive motor, not shown, and are configured to allow the fluid absorbing member 12 to be fed and wound by the rotation thereof respectively. In this embodiment, the rotating unit 15 is used for feeding the fluid absorbing member 12 and the rotating unit 16 is used for winding the fluid absorbing member 12. The rotating units 15 and 16 are demountably mounted to supporting panels 17, respectively.

The fluid absorbing member 12 to be held on the respective rotating units 15 and 16 are provided so as to extend between the shaft members 20A and 20B pivoted and fixed on the side of the surface 22*a* of the respective supporting panels 17 (the same side as the nozzle surfaces 23 of the printheads 21). Since the respective shaft members 20A and 20B are provided at positions farther from the surfaces of the respective supporting panels 17 on the side of the surface 22*a* than the nozzle surfaces 23 of the printheads 21, the fluid absorbing member 12 are prevented from coming into contact with the nozzle surfaces 23 of the printheads 21.

Then, through control of the rotating speeds of the rotating units 15 and 16 respectively by control devices, not shown, the fluid absorbing member 12 can be held in a state in which an adequate degree of tension is applied thereto without being sagged.

The moving mechanism 14 supports the respective supporting panels 17, is capable of moving the supporting panels 17 in the direction toward or away from the nozzle surface 23, and is capable of moving in the direction intersecting the direction of transport of the printing paper (the direction parallel to the nozzle surfaces 23). The moving mechanism 14 moves the fluid absorbing member 12 between a flashing position (first position: position indicated by solid lines in FIG. 4) opposing the nozzle rows L of the respective printheads 21 and a retracted position (second position: position indicated by broken lines in FIG. 4) farther from the nozzle surfaces 23 of the respective printheads 21 than the area of transport of the printing paper 8 between the printheads 21 and the platen 7 by moving the respective supporting panels 17 upward and downward. Since the gap between the nozzle surfaces 23 of the printheads 21 and the platen 7 is 2 mm, if the diameter of the fluid absorbing member 12 is assumed to be 1 mm, the fluid absorbing member 12 can be moved away from the nozzles only by moving the same by a distance on the order of 1 mm to 1.5 mm even with dimensional errors or arrangement errors of the components included. Therefore, only a short time is required for the movement of the fluid absorbing member 12. The fluid absorbing member 12 is a thread-type member, the mass is small even after having absorbed the ink, and hence only a small motive power is required for the movement, so that the movement is easy.

In contrast, the moving mechanism 14 changes the flashing position with respect to the respective printheads 21 by moving the respective supporting panels 17 in the direction of transport of the printing paper (the direction of arrangement of the nozzle rows parallel to the direction of transport of the printing paper), and brings the fluid absorbing member 12 to positions opposing the nozzle rows L which are different in the direction of transport.

The term "flashing position" in this specification means a state in which the fluid absorbing member 12 is arranged at positions opposing the nozzle rows L (the plurality of nozzles 24 which constitute the respective nozzle rows L) of the respective printheads 21 which constitute the same head groups M and N between the nozzle surfaces 23 and the platen 7, and includes positions which allows the fluid absorbing member 12 to absorb the ink discharged from the nozzle rows L located right above at the time of flashing operation (position on flyways of ink droplets). At this time, the fluid absorbing member 12 does not come into contact with the nozzles.

The fluid absorbing member 12 is arranged in parallel to the respective nozzle rows L of the plurality of printheads 21 arranged linearly in the direction intersecting the direction of transport of the printing paper at the flashing position (that is, when the flashing operation is performed). The fluid absorbing member 12 and the nozzle surface 23 are also arranged in parallel to each other. The term "parallel" here must simply fall within a range which allows the fluid absorbing member 12 to absorb the ink discharged from the respective nozzles, and does not have to be exactly parallel.

In this embodiment, the flashing operation is performed for each group of the nozzle row which discharges ink of the same color. Therefore, the fluid absorbing member 12 is needed to be arranged always at positions opposing the plurality of nozzle rows L corresponding to the respective colors. Accordingly, the moving mechanism 14 in this embodiment is configured to be capable of moving the fluid absorbing member 12 in the direction parallel to the nozzle surfaces 23 of the respective printheads 21. In other words, the fluid absorbing member 12 is arranged in sequence at positions opposing the nozzle rows L of the printheads 21 of the respective colors, that is, at positions opposing the plurality of nozzle rows L (the plurality of nozzles 24) corresponding to the respective colors between the head groups M and N by moving the supporting panels 17 in the direction parallel to the direction of transport of the printing paper.

In contrast, the term "retracted position" means the position farther from the nozzle surfaces 23 of the printhead 21 of the head unit 2 than the area of transport of the printing paper 8, and is a position where contact with the printing paper 8 is avoided at the time of printing operation and hence the transport is not hindered.

Figure 5:
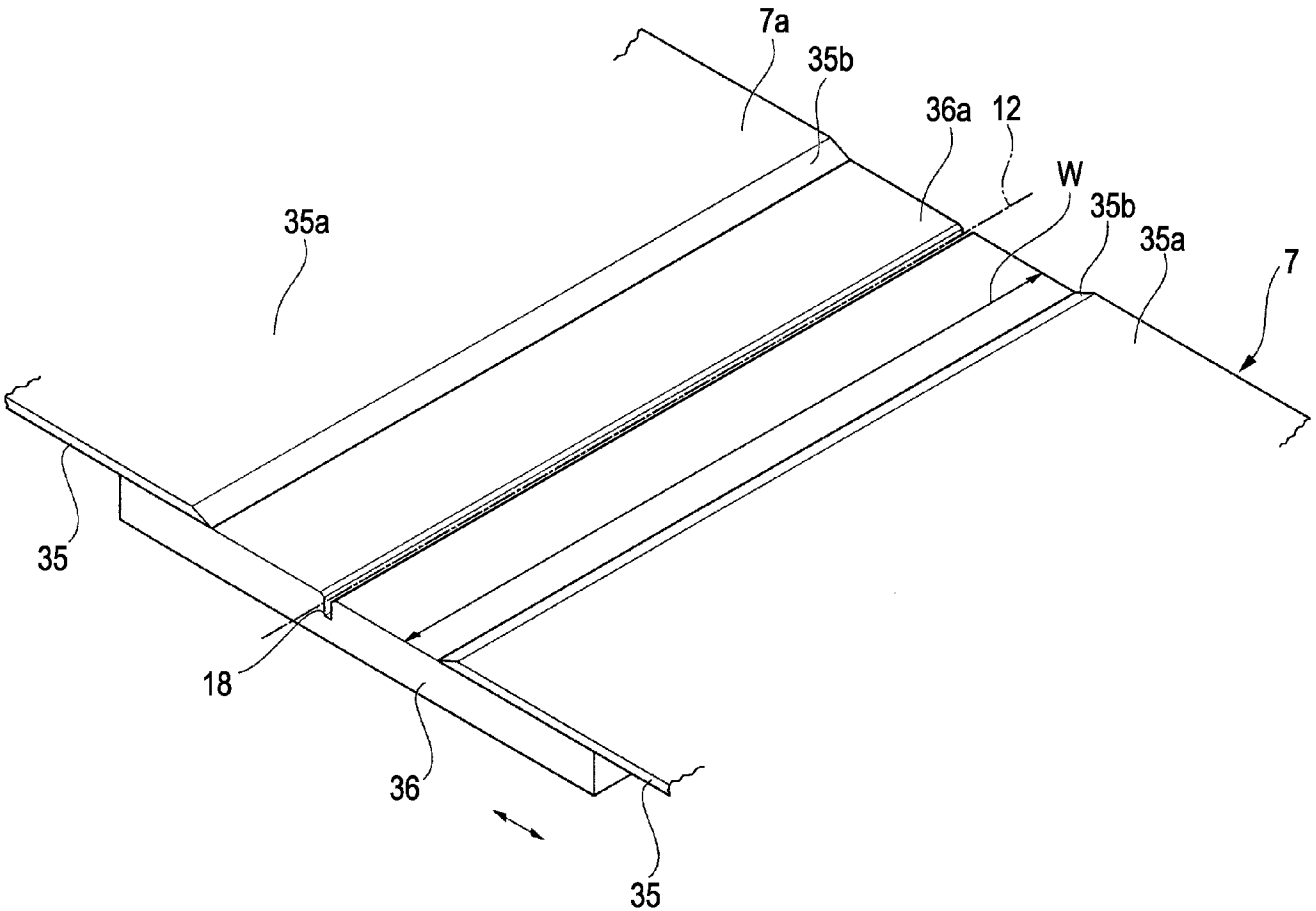
FIG. 5 is a perspective view of a schematic configuration of a platen in the first embodiment.
Figure 6A:
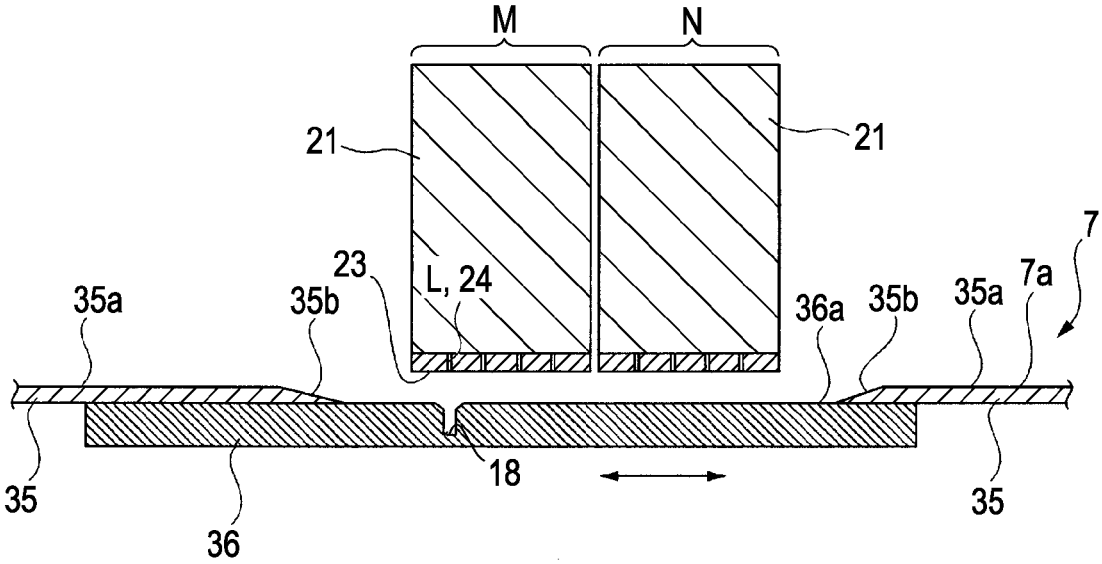
FIG. 6A is a cross-sectional view of the platen.
Figure 6B:
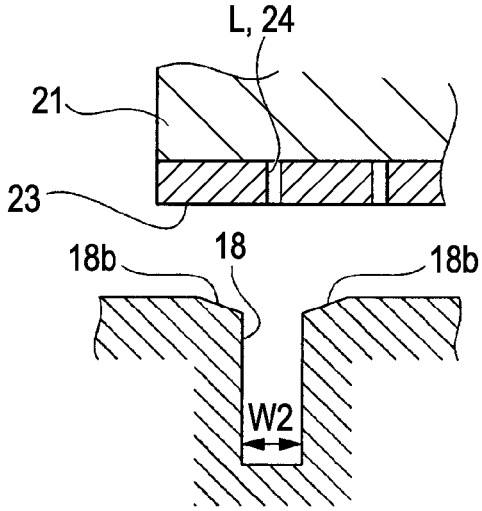
FIG. 6B is a partly enlarged cross-sectional view of the platen shown in FIG. 6A.

In this embodiment, the retracted position of the fluid absorbing member 12 is secured for the platen 7 which opposes the head unit 2. Here, the configuration of the platen 7 in this embodiment will be described in detail. FIG. 5 is a perspective view showing a schematic configuration of the platen in this embodiment. FIG. 6A is a cross-sectional view of the platen, and FIG. 6B is an enlarged cross-sectional view of the platen shown in FIG. 6A.

As shown in FIG. 5 and FIG. 6A, the platen 7 in this embodiment includes a pair of holding panel members 35 arranged at a predetermined distance in the direction of transport of the printing paper and a moving panel member 36 arranged so as to expose a surface 36*a* thereof between the pair of holding panel members 35 and movable in the direction parallel to the direction of transport of the printing paper with respect to the fixed holding panel members 35.

The moving panel member 36 is formed with a accommodating depression (depression) 18 which is capable of accommodating the fluid absorbing member 12 on the surface 36*a* thereof. The accommodating depression 18 is a groove formed over an entire width W of the platen 7 (the width in the direction intersecting the direction of transport of the printing paper), and has a dimension (depth) larger than the thread diameter of the fluid absorbing member 12 (FIGS. 6A and 6B). A width W2 (groove width) of the accommodating depression 18 is set to a width just enough to provide some amount of gap between the fluid absorbing member 12 accommodated therein and an inner wall thereof (FIG. 6B), so that the upstream end 8*a* in the direction of transport of the printing paper 8 transported along a surface 7*a* of the platen 7 never falls into the accommodating depression 18.

The opening side of the accommodating depression 18 is widened toward the surface 7*a* of the platen 7, and is configured to ensure insertion of the fluid absorbing member 12 into the depression via inclined surfaces 18*b* and 18*b* provided at an opening end thereof.

Through control of the movement of the moving panel member 36 by a control device, not shown, the moving panel member 36 is moved in the direction parallel to the direction of transport of the printing paper, and the accommodating depression 18 is arranged right below the predetermined nozzle rows L.

The printing paper 8 transported onto the platen 7 passes from a surface 35*a* of one of the holding panel members 35 through the surface 36*a* of the moving panel member 36 and moves to the surface 35*a* of the other holding panel member 35. In order to alleviate the disalignment between the holding panel members 35 and the moving panel member 36, the holding panel members 35 are formed with inclined surfaces 35*b* on the opposed ends thereof, respectively, so that the inclined surfaces 35*b* smoothen the transport of the printing paper 8.

The above-described retracted position of the fluid absorbing member 12 is a state in which the fluid absorbing member 12 is accommodated in the accommodating depression 18, and is a position retracted from the position opposing the nozzles 24 into the platen 7 located further below. In other words, it is a position farther from the nozzle surfaces 23 of the printheads 21 than the transporting area of the printing paper 8.

At the retracted position, the fluid absorbing member 12 does not project from the surface 7*a* of the platen 7, and does not hinder the movement of the printing paper 8 transported onto the platen 7 at the time of printing.

Subsequently, the operation of the printer 1 in this embodiment will be described.

Figure 7A:
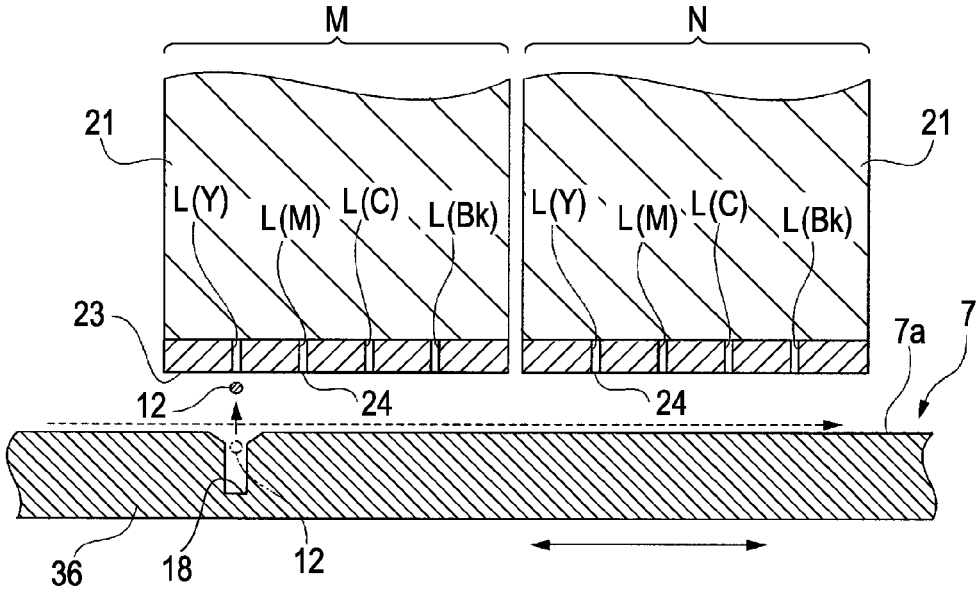
FIG. 7A is an explanatory drawing showing an operation of the printer in the first embodiment.
Figure 7B:
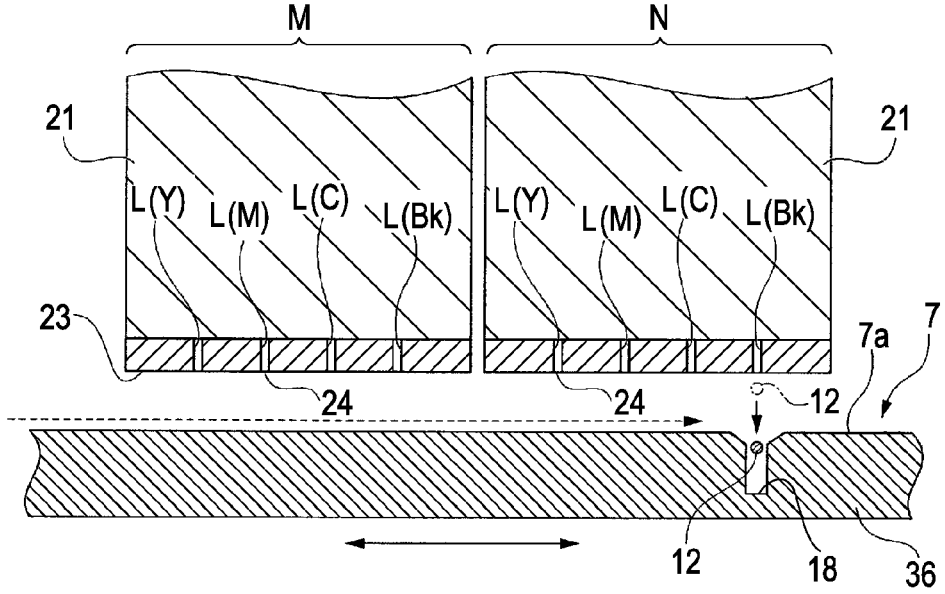
FIG. 7B is an explanatory drawing showing the operation of the printer in the first embodiment.

FIGS. 7A and 7B are explanatory drawings showing the operation of the printer 1 in this embodiment, and reference is made also to FIG. 4 as needed in the description given below.

All operations of the printer 1 in this embodiment are controlled by a control device, not shown, and the flashing operation is performed between the printing operations, that is, when a portion between the printing paper 8 and the printing paper 8 transported in sequence by the transporting device 3 is located right below the printhead 21.

In other words, in the printer 1 in this embodiment, the fluid absorbing member 12 is moved to a position opposing the predetermined nozzle rows L at a timing when the printing paper 8 is not present right below the head unit 2 (nozzles 24) by the moving mechanism 14 shown in FIG. 4 at the time of the flashing operation. More specifically, for example, at the time of the printing operation, when the gap between the printing papers 8 reaches the position below the printhead 21 in a state in which the fluid absorbing member 12 is arranged at the retracted position on the side of the platen 7 (indicated by broken lines in FIG. 7A and FIG. 4), the respective supporting panels 17 are moved upward, and the fluid absorbing member 12 is arranged at the flashing position opposing the nozzle row L (Y) (indicated by solid lines in FIG. 7A and FIG. 4). Then, when the fluid absorbing member 12 is arranged at the flashing position opposing the nozzle row L (Y), the control device performs the flashing operation by discharging the ink from the respective nozzles 24 which constitute the nozzle row L (Y).

The control device drives the moving mechanism 13 and moves the fluid absorbing member 12 thereby winding a portion of the fluid absorbing member 12 having absorbed the ink while the flashing operation is being performed. Accordingly, as the ink discharged from the nozzle rows L is always discharged onto a new part of the fluid absorbing member 12 which does not contain ink therein, the ink is absorbed quickly into the fluid absorbing member 12. The timing or speed of winding is adjusted as needed according to the type or the amount of discharge of the ink, or the ink capacity of the fluid absorbing member 12 so as to prevent the fluid absorbing member 12 from being saturated.

Subsequently, the moving mechanism 14 moves the fluid absorbing member 12 in the direction along the direction of transport of the printing paper, arranges the fluid absorbing member 12 at a position opposing the nozzle row L (M) adjacent to the nozzle row L (Y), and performs the flashing operation. Then, the flashing operations are performed for the nozzle row L (C) and the nozzle row L (Bk) in sequence.

When the flashing operations for all the nozzle rows L are completed, the moving mechanism 14 shown in FIG. 4 arranges the fluid absorbing member 12 again to the retracted position as shown in FIG. 7B by moving the respective supporting panels 17 (that is, the fluid absorbing member 12) downward.

The moving mechanism 14 arranges the pair of supporting panels 17 and 17 at the same position in the direction of transport of the printing paper to set the fluid absorbing member 12 in parallel to the nozzle rows L, so that the fluid absorbing member 12 moved downward toward the platen 7 is set to extend in parallel to the accommodating depression 18 on the platen 7.

When arranging the fluid absorbing member 12 at the retracted position, the control device moves the moving panel member 36 of the platen 7 in association with the movement of the fluid absorbing member 12. More specifically, for example, the moving panel member 36 is moved so that the accommodating depression 18 is present at a position opposing the fluid absorbing member 12 at a timing when the fluid absorbing member 12 is retracted to the retracted position. In other words, the moving panel member 36 is moved so that the accommodating depression 18 is positioned right below the fluid absorbing member 12. At this time, the nozzle row L which is the object of the flashing operation, the fluid absorbing member 12, and the accommodating depression 18 are aligned in the direction of transport of the printing paper. Accordingly, the fluid absorbing member 12 is moved vertically downward from the position opposing the last nozzle row L as the object of the flashing operation and is arranged at the retracted position in the accommodating depression 18 of the moving panel member 36.

When the fluid absorbing member 12 having absorbed the ink is arranged at the retracted position, the ink absorbed in the fluid absorbing member 12 moves into the accommodating depression 18 by its surface tension. The depth of the accommodating depression 18 is larger than the thread diameter of the fluid absorbing member 12, and hence the ink capacity of the fluid absorbing member 12 can be increased by moving the ink in the fluid absorbing member 12 into the accommodating depression 18 to some extent.

In order to prevent the ink attached in the accommodating depression 18 from adhering and becoming deposited, the fluid absorbing member 12 is fed preliminarily to perform cleaning of the accommodating depression 18 as needed using an unused portion of the fluid absorbing member 12 where the ink is not absorbed (a portion having high ink-absorbing capability) when the printing is not performed.

The printer 1 in this embodiment configured as described above includes the printheads 21 having the nozzle rows L each having the plurality of nozzles 24 which eject ink, the thread-type fluid absorbing member 12 which extends along the nozzle rows L and is movable from the flashing position to the retracted position, and the platen 7 configured to support the recording paper which is subjected to printing by the printheads 21 at a position opposing the printheads 21, and includes the moving mechanism 14 configured to move the fluid absorbing member 12 to the flashing position opposing the respective nozzle rows (nozzles 24) of the printheads 21 arranged in the direction intersecting the direction of transport f the printing paper and to the retracted position farther from the nozzle surfaces 23 of the printheads 21 than the area of transport of the printing paper.

In this embodiment, ink is ejected from the nozzles 24 to the thread-type fluid absorbing member 12 positioned at the flashing position where the fluid absorbing member 12 opposes the nozzles 24 between the printhead 2 and the platen 7. Since the fluid absorbing member 12 absorbs the ink at a position closer to the head unit 2 than the printing paper 8 or at the equivalent position, the ink can be absorbed without being transformed into mist.

In this embodiment, since the flashing position and the retracted position are aligned in the direction of transport of the printing paper, the fluid absorbing member 12 arranged at the position opposing the nozzle rows L can be retracted to the retracted position by moving the same downward as-is. Therefore, the distance of travel of the fluid absorbing member 12 between the flashing position and the retracted position can be shortened to the order of 1 mm to 1.5 mm. In this manner, since the time required for traveling of the fluid absorbing member 12 can be shortened by minimizing the distance of travel of the fluid absorbing member 12 and hence the amount of movement thereof, if the flashing operations are performed between the transported printing papers 8 such as in the case of the continuous printing, the distance between the printing papers can be reduced, so that high-speed printing is achieved.

In addition, since the mass of the thread-type fluid absorbing member 12 is small, the movement of the fluid absorbing member 12 from the retracted position to the flashing position opposing the nozzle rows L is achieved easily and, moreover, since the fluid absorbing member 12 can be moved to the retracted position with a small distance of movement, speeding up of the operation is enabled and the flashing operation can be ended in a short time.

In the related art, since the ink ejected by the flashing operation is received by a cap having a substantially same size as the printhead, securement of the place for arrangement is difficult. However, since a linear gap is enough to arrange the thread-type fluid absorbing member 12, flexibility of the place of arrangement is improved.

Furthermore, the fluid absorbing member 12 can be arranged at the positions opposing the nozzle rows L and, consequently, the distance between the nozzles 24 and the fluid absorbing member 12 is reduced. Accordingly, the ink discharged from the nozzles 24 is absorbed without being transformed into mist, so that the flashing throughput is improved.

Since the head unit 2 moves upward and downward according to the type of the printing paper to be transported, the platen gap between the nozzle surfaces 23 of the printheads 21 and the platen 7 vary. For example, the platen gap is increased when printing on a thick paper or a board. In this case as well, the discharged ink is prevented from being transformed into mist by moving the fluid absorbing member 12 upward according to the movement of the head unit 2 and arranging the same at the positions opposing the nozzle rows L.

Since the thread-type fluid absorbing member 12 is arranged in the accommodating depression 18 provided on the moving panel member 36 of the platen 7 when it is at the retracted position, it is positioned below the area of transport of the printing paper 8. Accordingly, the fluid absorbing member 12 is prevented from coming into contact with the fluid absorbing member during the transport of the printing paper, so that a paper jamming during the printing operation is prevented even at a high paper-feeding speed.

Since the fluid absorbing member 12 is of the thread type, the size of the accommodating depression 18 may be small. In addition, since the depth of the accommodating depression 18 provided on the platen 7 is larger than the thread diameter of the fluid absorbing member 12, the capacity of the fluid absorbing member 12 (the absorbable amount of ink) can be increased by moving the ink absorbed in the fluid absorbing member 12 at the time of the flashing operation into the accommodating depression 18 by the surface tension thereof. Accordingly, the frequency of winding of the fluid absorbing member 12 and cleaning the interior of the accommodating depression 18 during the continuous printing can be reduced.

In addition, probability of attachment of the ink to the back surface of the printing paper when winding the fluid absorbing member 12 after having absorbed the ink is reduced. Assuming that the same capacity is required, the thread diameter of the fluid absorbing member 12 can be reduced in comparison with the case where the ink is absorbed only by the fluid absorbing member 12 by an amount corresponding to the amount of ink to be received in the accommodating depression 18. Accordingly, a higher-speed traveling of the fluid absorbing member 12 becomes possible by reducing the mass thereof, whereby the high-speed printing is achieved.

In addition, the ink is prevented from adhering and depositing in the accommodating depression 18 by performing cleaning in the accommodating depression 18 by feeding the fluid absorbing member 12 preliminarily when the printing is not performed and using the portion with high ink-absorbing capability such as the unused portion of the fluid absorbing member 12 (the portion where the ink is not absorbed), so that the stable flashing process is performed.

Probability of contamination of the back surface of the printing paper 8 by residual ink is also eliminated by performing the cleaning of the interior of the accommodating depression 18 entirely with the unused portion of the fluid absorbing member 12.

By setting the width W2 (groove width) of the accommodating depression 18 to a width just enough to provide some amount of gap between the fluid absorbing member 12 to be inserted therein and the inner wall of the fluid absorbing member 12, the ink attached to the inner wall surface of the accommodating depression 18 is absorbed by the fluid absorbing member 12 and the interior of the accommodating depression 18 can be cleaned up with a capillary force of the thread woven by fine fibers.

In this embodiment, the fluid absorbing member 12 is arranged between the flashing position and the retracted position by moving the respective supporting panels 17 upward and downward using the moving mechanism 14 in a state in which a tension is applied to the fluid absorbing member 12 by controlling the rotations of the rotating units 15 and 16 by the control devices, respectively. However, when arranging the fluid absorbing member 12 at the retracted position, the fluid absorbing member 12 may be moved downward and arranged at the retracted position by allowing the fluid absorbing member 12 to sag by not applying the tension. Since the fluid absorbing member 12 is moved upward by winding the same, complicated thread traveling mechanism is not necessary. In this case, by providing a weight on the fluid absorbing member 12, the thread can be operated with higher degree of accuracy.

The thread-type fluid absorbing member 12 has a problem such that it is subjected to vibrations, so that the fluid absorbing member may be deviated from the area which allows receipt of the ink due to the vibrations and hence may make the printing paper or the like dirty. However, in this embodiment, since the fluid absorbing member 12 is capable of retracting into the accommodating depression 18, the vibrations of the fluid absorbing member 12 at the retracted position are reliably prevented. Accordingly, for example, the problem such that the printing paper 8 is made dirty by the vibrating fluid absorbing member 12 after having absorbed the ink is prevented.

Figure 8:
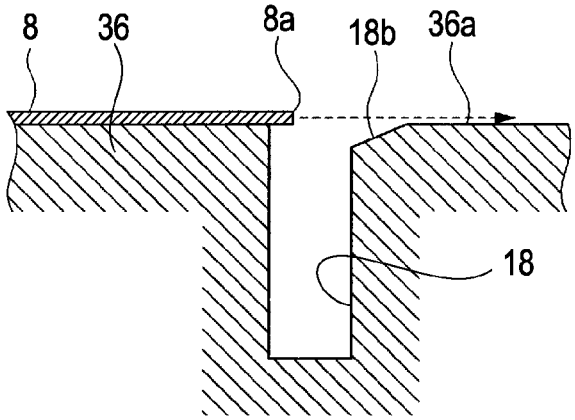
FIG. 8 is an enlarged cross-sectional view showing a modification of an accommodating depression.

In this embodiment, the inclined surfaces 18*b* and 18*b* are provided at both sides of the opening end of the accommodating depression 18 (the both ends opposing with respect to each other in the direction of transport of the printing paper). However, the inclined surface 18*b* is not necessarily required to be provided on the both sides and is preferably provided at least at the end which is located on the downstream side of the direction of transport of the printing paper 8 as shown in FIG. 8. Accordingly, the upstream end 8*a* in the direction of transport of the transported printing paper 8 hardly drops into the accommodating depression 18, and is guided again to the surface 36*a* of the moving panel member 36 via the inclined surface 18*b*. In this manner, the configuration in which the inclined surface 18*b* is provided only on one side of the accommodating depression 18 has higher effect to prevent the end of the printing paper 8 from dropping into the accommodating depression 18.

Here, in this embodiment, in order to vary the gap between the platen 7 which supports the printing paper and the head unit 2 in accordance with the type of the printing paper 8, the head unit 2 is configured to be capable of advancing and retracting with respect to the platen 7 by being moved upward and downward. From this reason, in this embodiment, a configuration in which whether the fluid absorbing member 12 is to be moved to the first position or not can be selected as needed according to the type of the printing paper 8 at the time of the flashing operation is also applicable.

In this manner, with the configuration in which the platen gap is varied according to the type of the printing paper 8, the platen gap is reduced when the printing paper 8 is thin. In other words, if the platen gap is reduced, the nozzles 24 and the fluid absorbing member 12 get closer to each other consequently. Therefore, even when the flashing operation is performed without moving the fluid absorbing member 12 to the position opposing the nozzles 24 at the time of the flashing operation, the ink discharged from the respective nozzles 24 is absorbed by the fluid absorbing member 12 before being transformed into mist.

In contrast, when performing the flashing operation during the printing on a thick printing paper, since the platen gap is increased, the fluid absorbing member 12 is moved upward and is arranged at the position opposing the nozzles 24, so that the above-described satisfactory flashing operation is achieved.

In this manner, the fluid absorbing member is arranged at the position opposing the nozzles 24 or at the retracted position according to the type of the recording paper at the flashing operation. In other words, the configuration to select whether the fluid absorbing member 12 is moved to the position opposing the nozzles 24 or not according to the type of the printing paper 8 gives easier driving and achieves power saving. Since the flashing operation can be performed at the retracted position without moving the fluid absorbing member 12 to the position opposing the nozzles 24, shortening of the processing time is achieved, and the printing speed is improved.

Subsequently, other embodiments of the invention will be described.

The basic configurations of the printer of the respective embodiments shown below are substantially the same as that in the first embodiment, but the configuration of the platen is different. Therefore, in the description given below, the platen will be described in detail, and description of other common portions will be omitted. In the drawings used in the description, common components as in FIG. 1 to FIG. 7B are designated by the same reference numerals.

Second Embodiment

Figure 9:
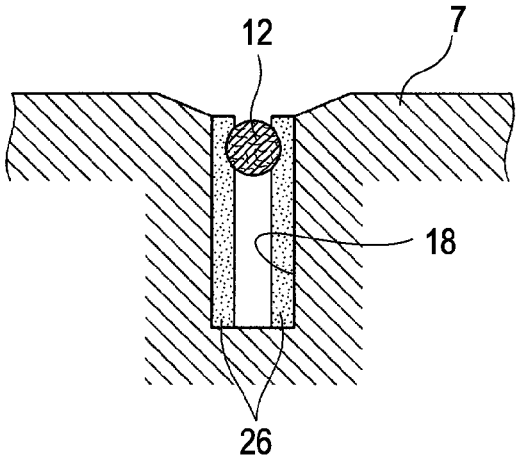
FIG. 9 is a perspective view showing a schematic configuration of an accommodating depression of a printer in a second embodiment.

Referring now to FIG. 9, a printer in a second embodiment of the invention will be described. FIG. 9 is a cross-sectional view showing a configuration of a principal portion of the platen in the second embodiment.

As shown in FIG. 9, the platen 7 of the printer in this embodiment is provided with a pair of ink absorbing members 26 which absorb ink in the accommodating depression 18. The ink absorbing members 26 are arranged respectively along the inner wall surfaces of the accommodating depression 18 over the entire length thereof in the direction of extension, and a gap 27 for allowing insertion of the fluid absorbing member 12 is provided between the ink absorbing members 26 and 26. The gap 27 is set to be smaller than the thread diameter of the fluid absorbing member 12, whereby the surface areas of the respective ink absorbing members 26 which come into contact with the peripheral side surface of the fluid absorbing member 12 accommodated therein is increased, and hence a larger amount of ink can be absorbed from the fluid absorbing member 12. As the ink absorbing members 26, sponge members or porous members are exemplified.

In this configuration, ink in the fluid absorbing member 12 can be moved toward the ink absorbing members 26 quickly, so that the ink capacity in the fluid absorbing member 12 can be restored to a nearly initial state. Accordingly, the frequency of winding of the fluid absorbing member 12 and cleaning the interior of the accommodating depression 18 during continuous printing can be reduced, and the interval of replacement of the fluid absorbing member 12 can be elongated. The ink absorbing members 26 may be configured to be replaceable as needed.

If the gap between the ink absorbing members 26 is set to a dimension which causes part of the respective ink absorbing members 26 to be compressed by the fluid absorbing member 12 arranged in the accommodating depression 18, the ink absorbing members 26 can be cleaned and hence are kept clean.

Figure 10:
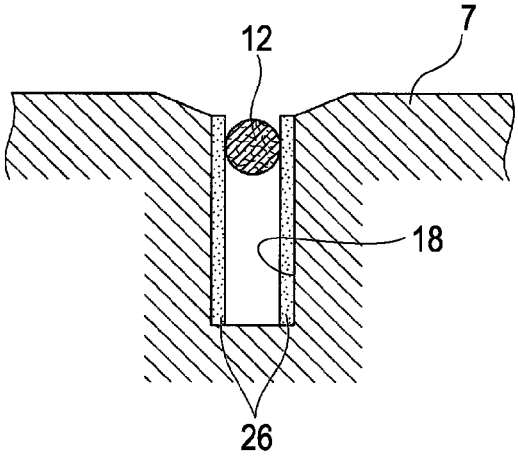
FIG. 10 is a perspective view showing a modification of the accommodating depression of the printer in the second embodiment.

In contrast, as shown in FIG. 10, if the gap between the ink absorbing members 26 is set to be substantially the same as or smaller than the thread diameter of the fluid absorbing member 12 to some extent, the ink absorbing members 26 are never partly compressed by the fluid absorbing member 12. Therefore, the fluid absorbing member 12 only comes into contact with the respective ink absorbing members 26, and hence the ink can easily be absorbed and the ink capacity in the ink absorbing members 26 is increased to some extent.

Third Embodiment

Figure 11A:
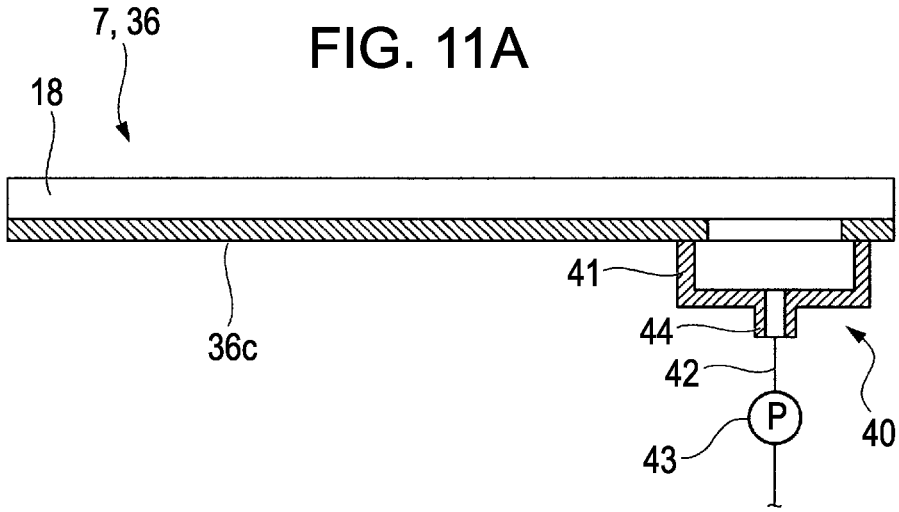
FIG. 11A is a cross-sectional view showing a configuration of a principal portion of a printer in a third embodiment.
Figure 11B:
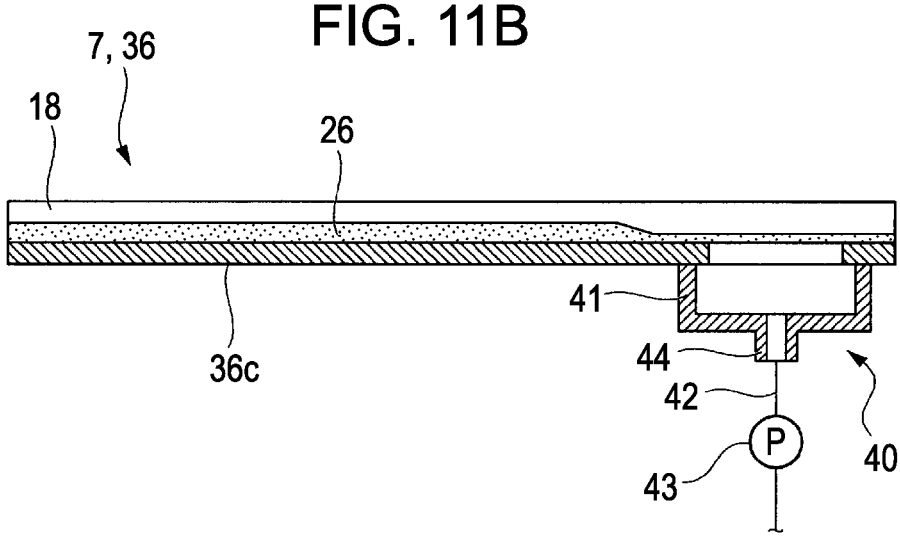
FIG. 11B is a cross-sectional view of the principal portion of the printer in a modification of the third embodiment.
Figure 11C:
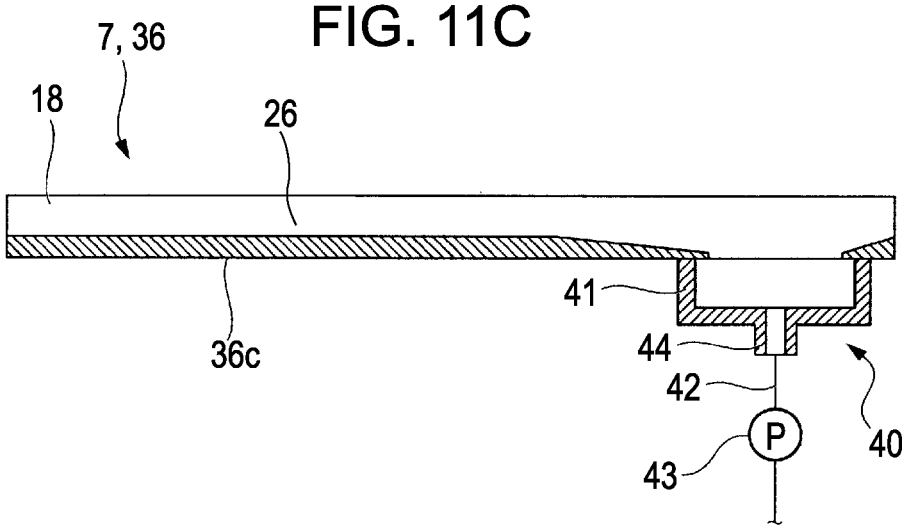
FIG. 11C is a cross-sectional view of the principal portion of the printer in another modification of the third embodiment.

Referring now to FIGS. 11A to 11C, a printer in a third embodiment of the invention will be described. FIG. 11A is a cross-sectional view showing a configuration of a principal portion of the platen in the third embodiment. FIGS. 11B and 11C are cross-sectional views showing a modification of the third embodiment.

As shown in FIG. 11A, the platen of the printer in this embodiment is provided with an ink suction mechanism 40 which collect ink in the accommodating depression 18. The ink suction mechanism 40 includes an ink trapping member 41, a suction channel 42, and a suction pump 43. The ink trapping member 41 has a bottomed box shape having a space which allows temporary storage of ink therein. The ink trapping member 41 is provided on a back surface 36*c* side of the moving panel member 36, which constitutes the platen 7, and the interior of the accommodating depression 18 and the above-described space are in communication with each other via an opening, not shown, provided on a bottom portion on one end side of the accommodating depression 18.

A suction port 44 is provided at the center of the bottom portion of the ink trapping member 41 so as to penetrate therethrough. The suction channel 42 is connected to the suction port 44, and the suction pump 43 is connected to the suction channel 42.

The printer in this configuration is capable of sucking ink in the accommodating depression 18 and discharging the same by the action of the suction pump 43. In this manner, the ink capacity in the accommodating depression 18 is increased by forcedly discharging ink present in the accommodating depression 18 by the suction pump 43, which consequently increases the ink capacity in the fluid absorbing member 12.

With the provision of the ink trapping member 41, the ink in the accommodating depression 18 can be stored temporarily therein, so that the ink in the accommodating depression 18 is prevented from flowing over. It also contributes to reduce the operation frequency and the driving time of the suction pump 43.

As shown in FIG. 11B, if the ink absorbing members 26 are arranged in the accommodating depression 18, it is preferable to compress end portions of the ink absorbing members 26 on the side of the ink trapping member 41 by collapsing or the like. By reducing the pore size in the ink absorbing members 26 in this manner, the ink can easily be moved toward the compressed end portion by the capillary force. Therefore, the ink present in the accommodating depression 18 on the opposite side from the ink suction mechanism 40 can be sucked to the last drop, which contributes to stabilization of the flashing performance.

As shown in FIG. 11C, it is also possible to form inclinations on the bottom portion of the accommodating depression 18. In other words, by forming the bottom portion of the accommodating depression 18 so as to be lower toward the ink trapping member 41, the ink accommodated in the accommodating depression 18 moves toward the ink trapping member 41 spontaneously. Accordingly, the ink is prevented from remaining on the other side portion of the accommodating depression 18 which the sucking action of the suction pump 43 can hardly act on.

Fourth Embodiment

Figure 12:
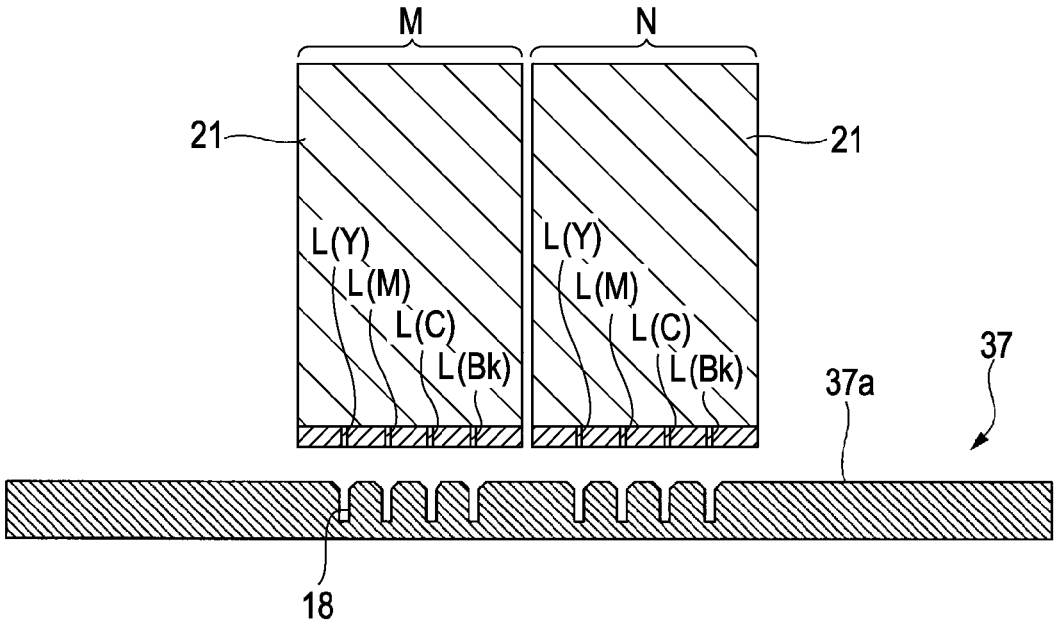
FIG. 12 is a cross-sectional view showing a configuration of a principal portion of a printer according to a fourth embodiment.

Referring now to FIG. 12, the printer in this embodiment will be described. FIG. 12 is a cross-sectional view showing a configuration of a principal portion of the platen in a fourth embodiment.

As shown in FIG. 12, a platen 37 of the printer in this embodiment does not include a plurality of plate members, but includes a single plate member having a plurality of the accommodating depressions 18 on the surface (printing paper supporting surface) side. The plurality of accommodating depressions 18 include two sets of four accommodating depressions 18 corresponding to the nozzle rows L (Y), L (M), L (C), and L (Bk) of the respective colors of the head unit 2 so as to correspond to the respective head groups M and N, that is, eight accommodating depressions 18 in total are provided in the direction of transport.

Since the accommodating depressions 18 are located right below the respective nozzle rows L, the necessity to move the platen in association with the movement of the fluid absorbing member 12 in the direction of transport of the printing paper is eliminated. Accordingly, since the positions of the nozzle rows L of the respective printheads and the accommodating depressions 18 of the platen are fixed only by the positioning at the time of assembly, positioning at a high-degree of accuracy of the platen 37 with respect to the fluid absorbing member 12 is not necessary during the action. Accordingly, the positional accuracies of the respective members are improved, and hence the fluid absorbing member 12 arranged at the respective flashing positions for the nozzle rows L of the respective colors can be moved reliably to the retracted positions in the predetermined accommodating depression 18 only by moving the same downward as-is.

In this embodiment, one piece of the fluid absorbing member 12 is used. However, eight fluid absorbing members 12 in total corresponding to the nozzle rows L of the respective colors may be used. In this case, the flashing operation can be performed simultaneously with respect to the respective nozzle rows L (nozzles 24) of all the printheads 21 provided on the head unit 2, so that the processing time can be shortened.

The plurality of fluid absorbing members 12 can be retracted respectively into the accommodating depressions 18 provided on the platen.

In this embodiment, during printing, a borderless printing is also supported by causing the plurality of fluid absorbing members 12 arranged at the retracted positions to absorb ink discharged from the respective nozzles 24 of the respective printheads 21.

Although the preferable embodiments of the invention has been described thus far referring to the attached drawings, the invention is not limited to the embodiments described above as a matter of course, and the embodiments may be combined. It is apparent for those skilled in the art that the invention may be improved or modified within the scope of the invention described in appended claims, and these improvements or modifications are apparently included in the technical scope of the invention.

For example, in the embodiments described above, one piece of the fluid absorbing member 12 is assigned for the plurality of nozzle rows L arranged in the direction intersecting the direction of transport of the printing paper. However, the invention is not limited thereto, and a configuration in which one fluid absorbing member 12 is assigned to a pair of the nozzle rows L adjacent in the direction of transport of the printing paper is also applicable.

The flashing operation may be performed for all the nozzle rows L of the plurality of printheads 21 provided on the head unit 2, and may also be performed only for specific nozzle rows L.

In the embodiments described above, the configuration in which the plurality of heads are arranged over the effective printing width has been described. However, the invention is not limited thereto, and a configuration in which a single line head is provided as the printhead is also applicable.

In the embodiments described above, the configuration in which the invention is applied to the line head printer has been described. However, the invention is not limited thereto, and may be applied to a serial printer.

In the embodiments described above, the configuration in which the positional relationship between the fluid absorbing member 12 and the printheads 21 is changed by moving the fluid absorbing member 12 is employed. However, the invention is not limited thereto, and a configuration in which the positional relationship between the fluid absorbing member 12 and the printheads 21 is changed by moving the printheads 21 may be employed.

In the embodiments described above, the ink jet printer is employed. However, a fluid ejecting apparatus configured to eject or discharge fluid other than ink and a fluid container accommodating the fluid may be employed. The fluid ejecting apparatus in this embodiment may be applied to various fluid ejecting apparatuses including a fluid ejecting head for discharging a minute amount of liquid drop. The term "liquid drop" indicates the state of fluid discharged from the fluid ejecting apparatus, and includes particle state, tear drop state, and thready state. The fluid here may be any material as long as it can be ejected by the liquid ejecting apparatus.

For example, it may be a substance in the state of liquid phase, and includes not only liquid state substance having a high or low viscosity, fluid state substance such as inorganic solvent such as sol and gel water, organic solvent, solution, liquid state resin, liquid state metal (melted metal), or fluid as a state of the substance, but also those obtained by dissolving, dispersing, or mixing particles of functional material formed of solid state substance such as pigment or metal particles in the solvent. Representative examples of the fluid include ink as described in the embodiments and liquid crystal. The term "ink" here includes various fluid compositions such as general water-based ink, oil-based ink, gel ink, and hot-melt ink.

Detailed examples of the fluid ejecting apparatus include fluid ejecting apparatuses which ejects fluid containing materials such as electrode material or colorant used for manufacturing liquid crystal displays, EL (electroluminescence) displays, surface emission-type displays, or color filters in the form of dispersion or dissolution, fluid ejecting apparatuses which eject biological organic substance used for manufacturing biochips, fluid ejecting apparatuses which are used as accurate pipettes and eject fluid as a sample, text printing apparatuses, or microdispensers.

Furthermore, a fluid ejecting apparatus for ejecting lubricant for pinpoint lubrication for precise machines such as watches or cameras, a fluid ejecting apparatus for ejecting transparent resin liquid such as UV-cured resin on a substrate for forming micro-semispherical lens (optical lens) used for optical communication elements or the like, or a fluid ejecting apparatus for ejecting etching liquid such as acid or alkali for etching the substrate or the like may be employed. The invention may be applied to any one of the ejecting apparatuses and the fluid container.

The entire disclosure of Japanese Patent Application No. 2009-248932, filed Oct. 29, 2009 is expressly incorporated by reference herein.

What is claimed is:

1. A fluid ejecting apparatus comprising:

a fluid ejection head configured to eject fluid from a plurality of nozzles;

a medium supporting member configured to support a medium at a position opposing the fluid ejection head, a thread-type fluid absorbing member configured to absorb the fluid ejected from the nozzles; and a moving mechanism configured to cause the fluid absorbing member to move between a first position opposing the nozzles between the fluid ejection head and the medium supporting member and a second position farther from a nozzle surface of the fluid ejection head than a transporting area of the medium, wherein the fluid is ejected from the nozzles to the fluid absorbing member at the first position, wherein the second position is a state in which the fluid absorbing member is accommodated in a depression provided on the medium supporting member.

2. The fluid ejecting apparatus according to claim 1, comprising an absorbing member configured to absorb the fluid in the depression.

3. The fluid ejecting apparatus according to claim 1, comprising a sucking mechanism configured to suck the fluid in the depression.

4. The fluid ejecting apparatus according to claim 1, wherein the moving mechanism has a function to move the fluid absorbing member in the direction parallel to the nozzle surface of the fluid ejection head.

5. The fluid ejecting apparatus according to claim 4, wherein the fluid ejection head includes a plurality of nozzle rows, and the moving mechanism has a function to move the fluid absorbing member in the direction of arrangement of the nozzle rows.

6. The fluid ejecting apparatus according to claim 1, wherein the medium supporting member includes a moving panel member configured to be movable in the direction parallel to the nozzle surface of the fluid ejection head, and the moving panel member is formed with the depression.

7. The fluid ejecting apparatus according to claim 1, wherein a plurality of the depressions are provided and the plurality of depressions oppose the nozzle rows arranged on the fluid ejection head in the direction of transport of the medium, respectively.

8. The fluid ejecting apparatus according to claim 1, comprising a moving mechanism having a function to adjust a tension to be applied to the fluid absorbing member, wherein the first position is a state in which the tension is applied to the fluid absorbing member by the moving mechanism and the second position is a state in which the tension is not applied to the fluid absorbing member by the moving mechanism.

9. A maintenance method comprising:

performing a flashing operation for causing fluid to be ejected from a plurality of nozzles of a fluid ejection head to a thread-type fluid absorbing member by moving the fluid absorbing member to a first position opposing the nozzles of the fluid ejection head, and then moving the fluid absorbing member having absorbed the fluid discharged from the nozzles to a second position which is farther from the nozzle surface of the fluid ejection head than a transporting area of the medium, wherein the second position is a state in which the fluid absorbing member is accommodated in a depression provided on a medium supporting member.

* * * * *